US005257787A

United States Patent [19]

Miccio

[11] Patent Number: 5,257,787

[45] Date of Patent: Nov. 2, 1993

[54] CHESS-LIKE GAME

[76] Inventor: Joseph A. Miccio, 15 Barlow Ave., Glen Cove, N.Y. 11542

[21] Appl. No.: 10,289

[22] Filed: Jan. 28, 1993

[51] Int. Cl.[5] ..... A63F 3/02; G09B 19/22

[52] U.S. Cl. ..... 273/260; 434/128

[58] Field of Search ..... 273/260, 261, 241; 434/128

[56] References Cited

U.S. PATENT DOCUMENTS

| | | | |
|---|---|---|---|
| 1,405,988 | 2/1922 | Erwin | 273/260 |
| 3,656,756 | 4/1972 | Gribbon, Jr. | 273/241 |
| 3,684,285 | 8/1972 | Kane | 273/241 |
| 3,767,201 | 10/1973 | Harper et al. | 273/241 |
| 3,794,326 | 2/1974 | Bialek | 273/260 |
| 3,885,791 | 5/1975 | Chouinard | 273/261 |
| 3,887,190 | 6/1975 | Ameri | 273/261 |
| 3,938,808 | 2/1976 | Bockmon, Jr. | 273/288 |
| 4,150,828 | 4/1979 | Marchese | 273/260 |
| 4,411,433 | 10/1983 | Flynn | 273/260 |
| 4,504,060 | 3/1985 | Riihilnoma | 273/241 |

*Primary Examiner*—Benjamin H. Layno

*Attorney, Agent, or Firm*—Abelman Frayne & Schwab

[57] ABSTRACT

A chess-like game is provided to simplify the teaching and playing of basic chess. It includes a game board having a lesser number of squares, for example, five vertical rows and six horizontal rows. A reduced number of pieces are provided, with each opponent's set including one each of a KING, QUEEN, BISHOP, KNIGHT and ROOK and five PAWNS. The lesser number of pieces are set up on the smaller game board such that they still incorporate many of the basic interrelationships and strategic aspects of conventional chess while permitting a more rapid and simpler game.

14 Claims, 5 Drawing Sheets

CHESS-LIKE GAME

BACKGROUND OF THE INVENTION

The present invention relates to a chess-like game, and more specifically to a substantial simplification of the game to facilitate the teaching of chess, particularly to children. Most advantageously, while allowing for a substantial simplification and shortening of the game, many of the basic characteristics and strategy aspects of conventional chess are still maintained.

The game of chess is well known. Typically the game is played on a checker-like board having eight squares in each row, which are alternately light and dark colored. There are eight horizontal and eight vertical rows, so as to provide a total of 64 squares on the conventional chess board. Each player in the conventional chess game starts with eight pieces, a KING, a QUEEN, two each of a BISHOP, KNIGHT and ROOK, and eight PAWNS. The object of the game is to check mate the opponent's KING, that is, to place the KING in such a position that it cannot avoid being taken by the opponent's next move. The various other pieces on the game board are provided for both offensive and defensive protection of the KING.

Considering the size of the conventional chess board, and the number of pieces employed, a chess game can oftentimes take several hours. Also, in addition to conventional movements of the various pieces, certain less frequent movements are also permitted. These are referred to as castling, two square initial movement of the PAWN, and en passant. While these movements provide additional sophistication to the game, I have determined that they are not essential and detract from, and make more difficult the teaching of the basics of chess.

Various modifications of the chess game have previously been proposed to make the game more complex and challenging. Examples of such games are U.S. Pat. Nos. 4,504,060 to Rihilsoma, et al. 3,656,756 to Gribbon, Jr., 3,684,285 to Kane, 3,767,201 to Harper et al. and 3,794,326 to Bialek. However, whereas those games have been directed to increasing the complexity of basic chess so as to present a more challenging environment for experienced chess players, my invention substantially simplifies the game to readily facilitate its teaching for those wishing to learn chess, particularly children.

SUMMARY OF THE INVENTION

In order to make the game less intimidating, while retaining all the integral components in tact, the present invention simplifies both the game board and the number of pieces employed. Instead of eight vertical rows, I include five vertical rows. The end horizontal row includes the KING, QUEEN, and only one each of the BISHOP, KNIGHT and ROOK. Accordingly, there will now only be five PAWNS instead of the prior eight PAWNS. Consistent with the reduction in the number of vertical rows, I also advantageously reduce the number of horizontal rows. This speeds up the engagement of the opponent's pieces. In reducing the number of rows from eight I have determined that six is a particularly advantageous configuration. Thus, my preferred game board includes five vertical rows and six horizontal rows. Accordingly, in the initial set up the center board spacing between the opponent's pieces is reduced in half, from four rows to two rows.

Advantageously, my principal pieces in the opposed end horizontal rows are initially located such that both their function, and the interrelationship of the pieces, substantially corresponds with conventional chess, although their set up is different.

Recognizing the reduced initial spacing between the opponent's pieces, the preferred embodiment of my game dispenses with the ability of the PAWNS to advance two squares on their initial move, as well as their logically related en passant movement. Likewise, to simplify the game, and avoid having to explain more complex concepts to the individual using the present game to learn chess, my unique set up prevents castling as a permitted movement, eliminating the resultant confusion that could result in teaching this movement to the beginner. However, once the player develops the basic skills utilizing my game, the principal pieces may be initially rearranged in the initial set up so as to permit both KING side castling and QUEEN side castling. Another alternative set up is contemplated which only includes PAWNS, so as to further acquaint the player with the importance and sophistication of PAWN movement. This set up does permit PAWNS to advance two squares on their initial move, as well as en passant.

Accordingly, it is a principal object of the present invention to provide for a substantial simplification of chess, while retaining the basic aspects of the game.

A further object of the present invention is to provide a simplified chess-like game to facilitate the teaching of chess to children.

Yet another object of the present invention is to provide a chess-like game which retains the basic features and strategy of conventional chess, while allowing for much more rapid play towards a conclusion of the game.

Still another object of the present invention is to provide a simplified chess-like game, which includes a smaller checkerboard playing field, and only one each of the BISHOP, KNIGHT and ROOK, and five PAWNS in each players set of pieces, and in which the pieces are interrelated substantially as in conventional chess.

Still a further object of the present invention is to provide a simplified variation of chess, which include all the conventional chess pieces and their significant movements, while permitting more simplified and rapid play.

It will be appreciated that while the present invention provides an educational tool for the beginner learning the conventional game of chess, the reduced number of playing pieces, smaller game board, and overall reduction in the complexity of the game removes much of the intimidation from chess, while retaining the basic enjoyment and challenge.

These as well as various other advantages of the invention will become apparent upon consideration of the following drawings and description of a preferred embodiment.

BRIEF DESCRIPTION OF THE DRAWINGS

FIG. 5 is a variation of the initial set up of my game, which only includes PAWNS.

In the figures and their discussion, the following abbreviations will be used to designate the well-known chess pieces:

K—KING
Q—QUEEN
B—BISHOP
N—KNIGHT
R—ROOK
P—PAWN

Figure 1:
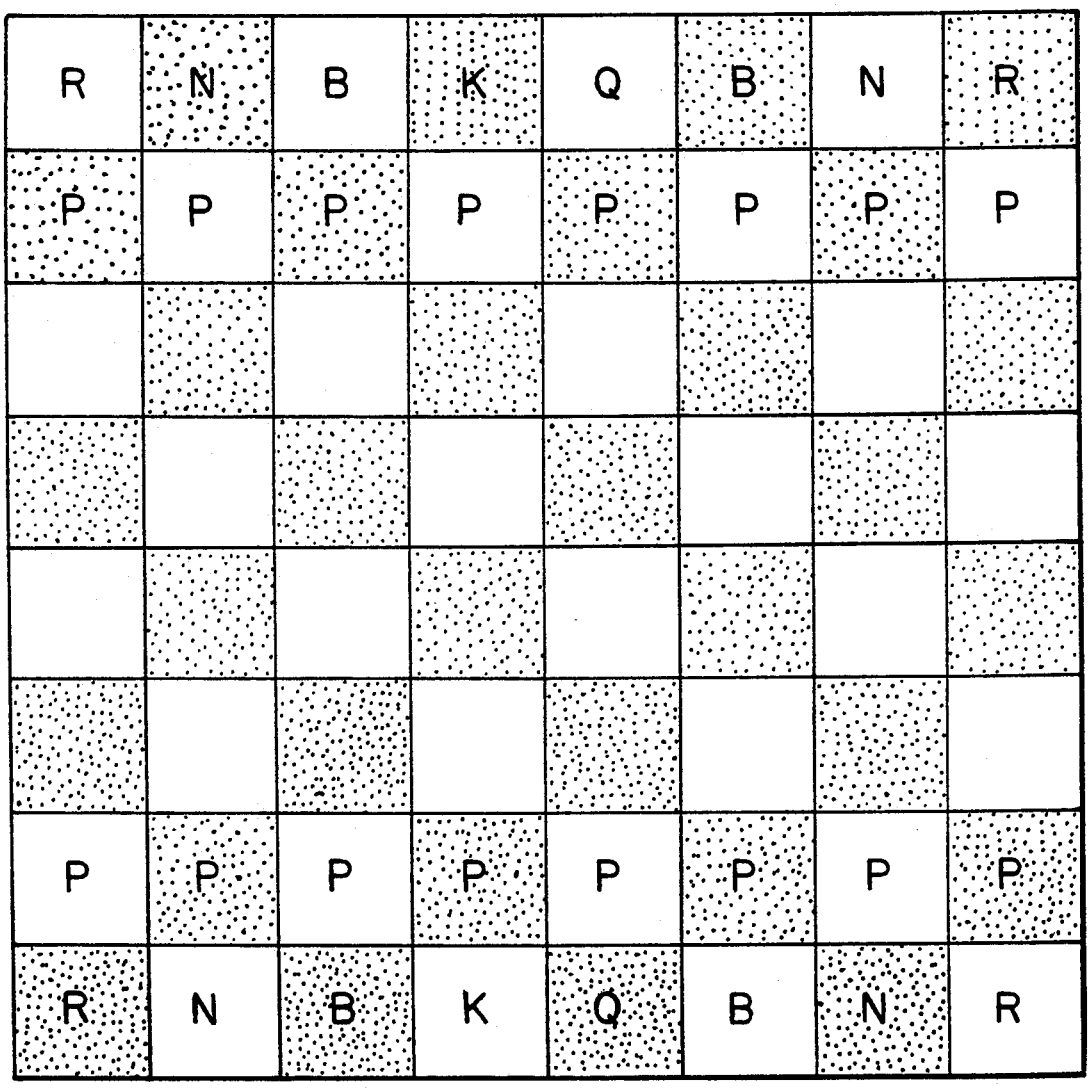
FIG. 1 PRIOR ART
FIG. 1 represents the prior art initial set up of conventional chess.

Referring to the conventional chess board 10, shown in FIG. 1, there are eight vertical rows, 11–18 and eight horizontal rows, 21–28. Each row includes alternate light and dark colored squares, with each square offset with respect to the similarly colored square of the adjacent row, forming the well-known checker board pattern. Referring to horizontal row 21, the pieces, looking from left to right, are set up in the order of R-N-B-K-Q-B-N-R. Row 22, immediately forward of row 21 includes eight PAWNS designated as P in FIG. 1. Correspondingly, rows 27 and 28 of the opponent's side includes the same initial set up, with opposed major pieces being in the same vertical row. That is, rows 11 and 18 include the ROOKS, 12 and 17 the KNIGHTS, 13 and 16, the BISHOPS, 14, the KING and 15 the QUEEN. The playing field initially includes four central horizontal rows, 23–26, devoid of pieces.

Figure 2:
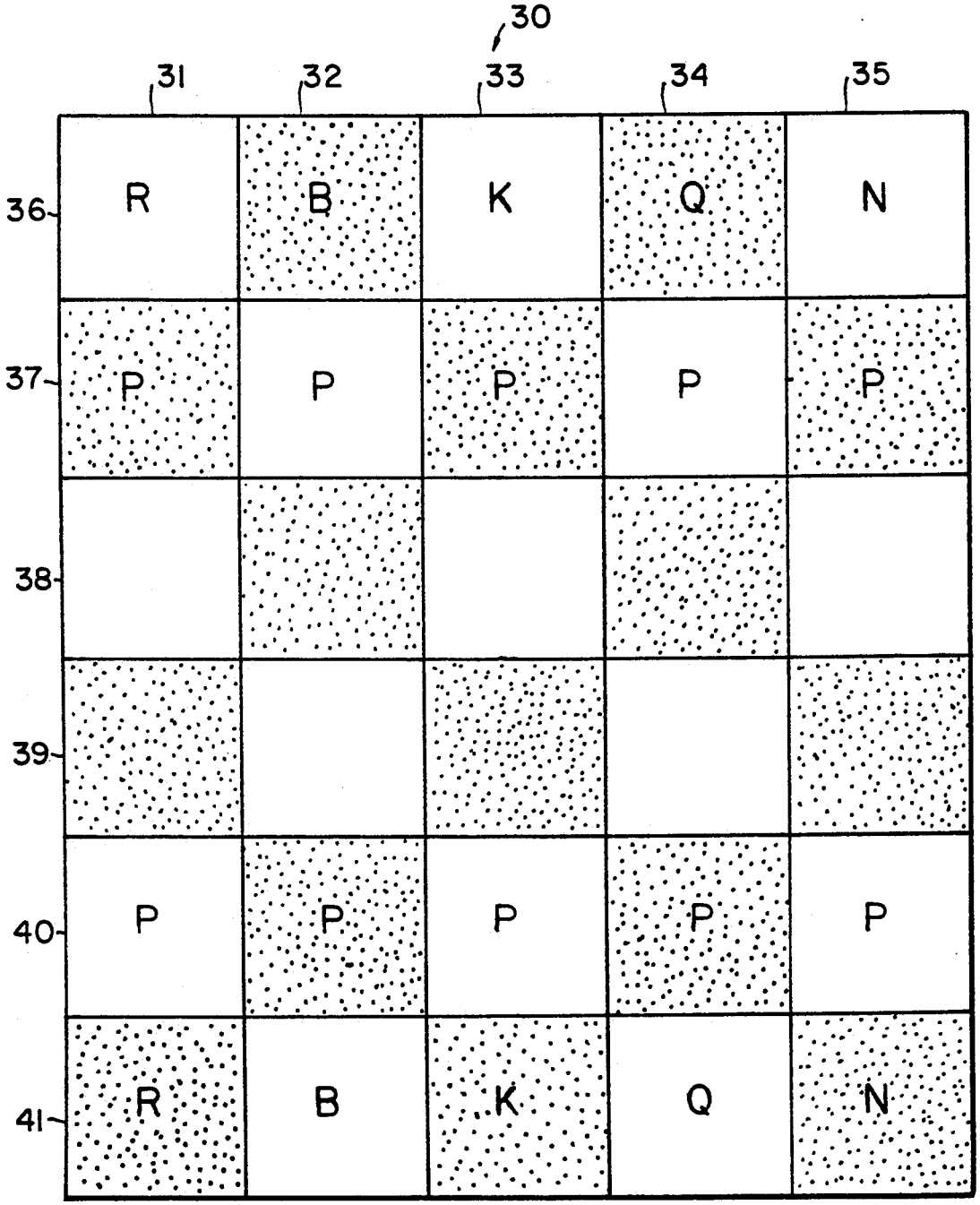
FIG. 2 is a presentation of the game board with the individual pieces in their initial set up corresponding to the start of the game.

Reference is now made to FIG. 2 which shows the game board and set up of the instant invention. The game board 30 includes five vertical rows, 31–35 and six horizontal rows, 36–41. Each player includes one each of the rook, BISHOP, KING, QUEEN and KNIGHT, which are set up, from left to right, in the order of R-B-K-Q-N. Each player includes five PAWNS set up in the immediately adjacent horizontal row in front of their principal players. Thus, there are only two horizontal rows, 38, 39, which are devoid of pieces during the initial set up.

The movement of each of the pieces correspond as follows to that permitted in conventional chess:

The ROOK moves horizontally or vertically, one direction at a time. It can move forward, backward, right or left, in a path of squares of alternating colors. On each move the ROOK may travel until it reaches the board's edge, if unobstructed. The ROOK may never move diagonally.

The BISHOP moves diagonally in a straight line always remaining on the same color throughout the game. A diagonal path travels from the corner of one square on the corner of the next diagonally adjacent square of the same color. On each move the BISHOP may travel until it reaches the board's edge, if unobstructed.

The KNIGHT is the only piece that can leap over other pieces. It has a fixed number of steps per move (three) and may only capture on its third step. The KNIGHT may move in either of two ways: 1) One square forward, backward or sideways; then two squares to the right or left. or 2) Two squares forward, backward or sideways; then one square to the right or left. The KNIGHT always ends its move resting on a square whose color is different from the color of the square it started from.

The PAWN moves forward only, one square per move. The PAWN does not capture as it moves forward. It may only capture diagonally on the two forward diagonally adjoining squares. When the PAWN reaches the opponent's base line it gets promoted to any piece the opponent has captured.

For any single move, the QUEEN may choose the path of a ROOK or the path of a BISHOP. That is, she moves either in a straight or diagonal path, but never from one to the other on the same move.

For any single move, the KING may move in any direction that the QUEEN may move, but each move is limited to one square.

As in conventional chess, the object of the game is to capture as many opponent's pieces as possible and to check-mate, or trap the KING so it cannot escape. When one player's piece lands on an opponent occupied square displacing that piece, the piece it is captured. When the KING is under attack by another piece it is in Check. The KING must immediately get out of check in one of the following ways:

1) Move to a square which is not under attack.
2) Capture the piece that is checking him.
3) Place one of his own pieces to block the Check.

If none of these conditions can be met, the KING is Checkmated and the game is lost.

There are certain less frequent moves permitted in the conventional chess game, as shown in FIG. 1, which I advantageously do not include in the simplified game of the instant invention so as to facilitate the teaching of the game. Further, some of these moves are rarely exercised and appear to contradict established and simple rules of the game. These moves, which it is believed are not necessary in order to learn the basics of chess are:

Castling: This is an optional one time move per game for each player, allowed only if certain (very complex to a beginner) conditions are met. There are two ways to castle and each player may not necessarily be able to exercise their option to castle. This move is probably one of the most confusing and intimidating of chess moves in that the KING and ROOK can "sort-of" switch places on one move thus violating all the other established rules that beginner has based his or her learning the game upon.

PAWNS advancing two squares on their first move: Every PAWN, on its first move of the conventional chess game as shown in FIG. 1 may deviate from its normal simple advancement pattern of one square at a time and advance two squares, even if it is late in the game and it did not move yet. Again, this is a move, to beginners, that can complicate their perception of how the pieces work, while they are still trying to learn how everything else works. This is not the normal movement pattern for the PAWN. It may tend to confuse the beginner, particularly when combining this with the diagonal way the pawns capture (They do not capture the way they move). Further, in my game the two square on the first move is not necessary for a more rapid engagement of the pieces, since the preferred game board of the instant invention only includes two rows (38–39) between the opponent's pieces, as initially set up, rather then the four rows, (23–26) as shown in the conventional chess set up of FIG. 1.

En Passant: This move is predicated when an opponent's PAWN has not advanced yet in the game and your PAWN is two spaces out and one space over from it. Your opponent then opts to advance his or her PAWN 2 spaces thus escaping your opportunity to capture it (diagonally) had it only advanced the one space it normally does. En Passant allows you to move (diagonally) to the position the opponent's pawn would have been had it not opted to advance two spaces.

When you do this you may remove the opponent's PAWN from the board and it is considered captured even though you never landed on the square it last occupied to displace it. En Passant is very conceptual and one would have to go into theory to explain the purpose of allowing this odd and confusing move. For a beginner it is a very confusing, intimidating and absolutely not necessary.

PAWN Promotions: A PAWN is "promoted" to any piece of its choice if it advances safely all the way to the opponent's edge of the board. Again, this presents some conceptual problems, in that in traditional chess you may have 2 or 3 QUEENS. Children easily understand getting something back, but have more difficulty understanding having pieces that do not exist. In order to maintain an incentive for advancing the PAWN to the opponent's end of the board, PAWN promotion has been limited to in the present game to only one of the pieces which has been lost to the opponent.

In the initial lineup of the pieces as shown in FIG. 2 each KING lines up in the center of its side of the board. The white KING is flanked on the right side by the QUEEN and KNIGHT (in that order) and on the left side by the BISHOP and ROOK (in that order). Each piece has one PAWN lined up directly in front of it. The black pieces line up on the opposite edge of the board mirroring the white ones.

This unique configuration accomplishes several important things. In traditional chess the KING is the fulcrum of combat and the game revolves around him. On a traditional board at the start of each game the KING, as shown in FIG. 1 is always flanked on one side by a QUEEN and the other by a BISHOP. Due to less pieces of the present invention, they have to be set up differently to maintain features of this inter-relationship yet still keeping the KING in the centre of the board. It is important that this configuration is kept. This is because either piece can move to the square directly in front of the KING to defend it. Generally the KING's PAWN is advanced first in traditional chess. This also serves to free the QUEEN or BISHOP so they can advance to attack. Again this relationship is still kept due to the unique way the pieces set up. The KING is still immediately surrounded in a familiar environment.

In this set up configuration of FIG. 2, each player's QUEEN starts resting on its own color square. That is, the light QUEEN on a light color square and the dark QUEEN on a dark square. This is an important and basic element in traditional chess for the game to develop properly.

As in traditional chess, the game of this invention starts with a KNIGHT set up two squares over from the KING. This enables the KNIGHT to act as a third piece to protect the square directly in front of the KING. As shown in FIG. 2 the KNIGHT is set up in the corner next to the QUEEN. This is the only way the KNIGHT can successfully defend or protect the square directly in front of the KING. Again, this accomplishes the way a third piece, the KNIGHT, can protect the square in front of the KING, as in traditional chess, although the KNIGHT is not protected by the ROOK as it would be in traditional chess, the QUEEN's new position next to the KNIGHT accomplishes this in its place.

The ROOK, as in traditional chess is set up in a corner. The square the ROOK rests upon is not protected in any way. The ROOK is solitary, just as in traditional chess, and relies on no other piece for protection. As in traditional chess, it still remains locked in until later in the game after the board opens up. Then it is used to close the attack on the opponent. Its main purpose until then is to protect the other pieces, particularly the KING, while they are still set up behind the PAWNS.

The positions shown in FIG. 2 are different than the way pieces line up in traditional chess. Yet the unique interrelationship of these positions provide similar protection and similar tactical challenges that traditional chess does, but on a scaled down basis. A player can build upon this when he or she advances up to traditional chess. This also makes the game more friendly to a beginner, allowing easy game development. This also allows for earlier combat thus keeping and developing the player's interest in the game.

Figure 3:
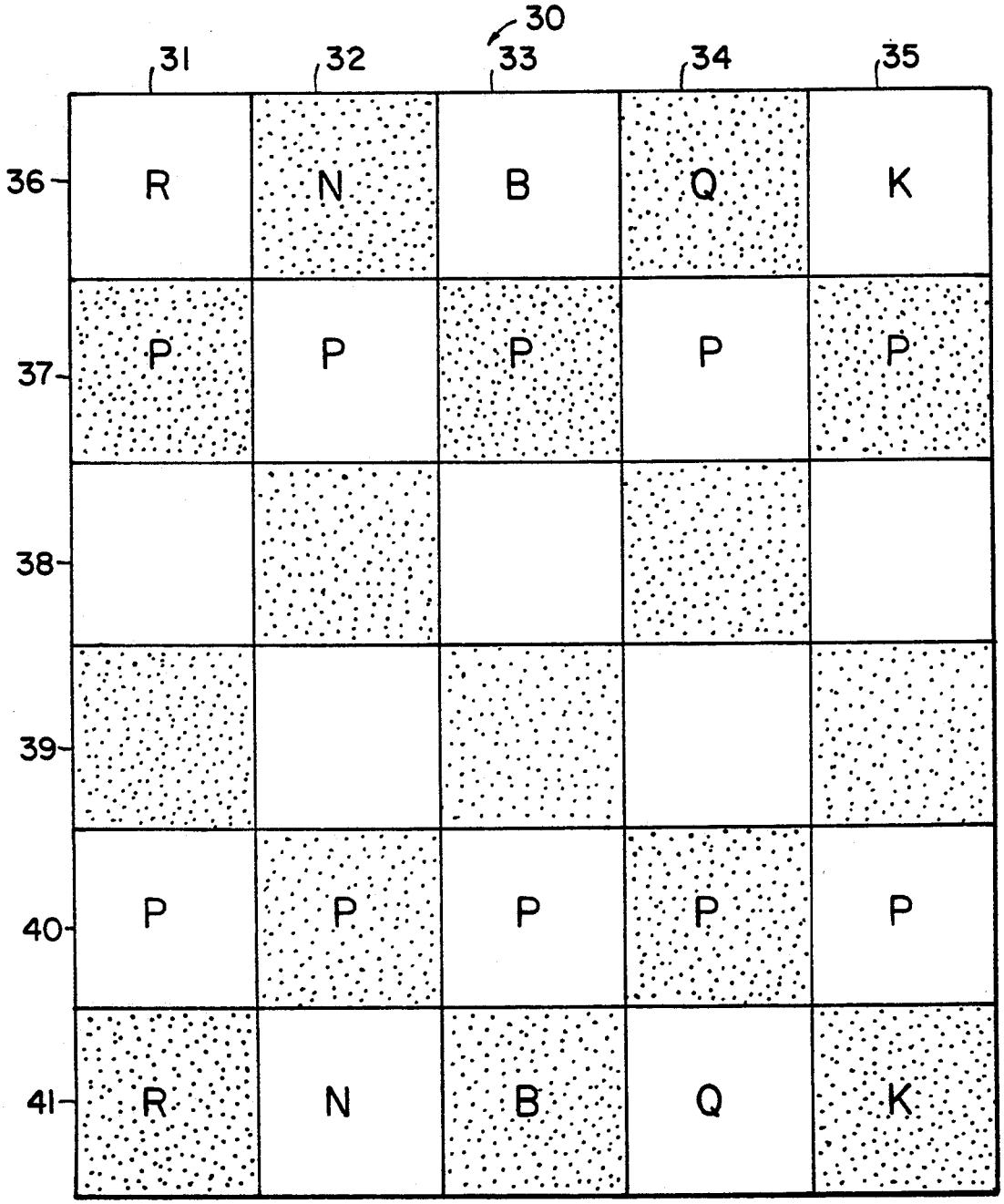
FIG. 3 is a variation of the initial set up of my game, for teaching QUEEN side castling.
Figure 4:
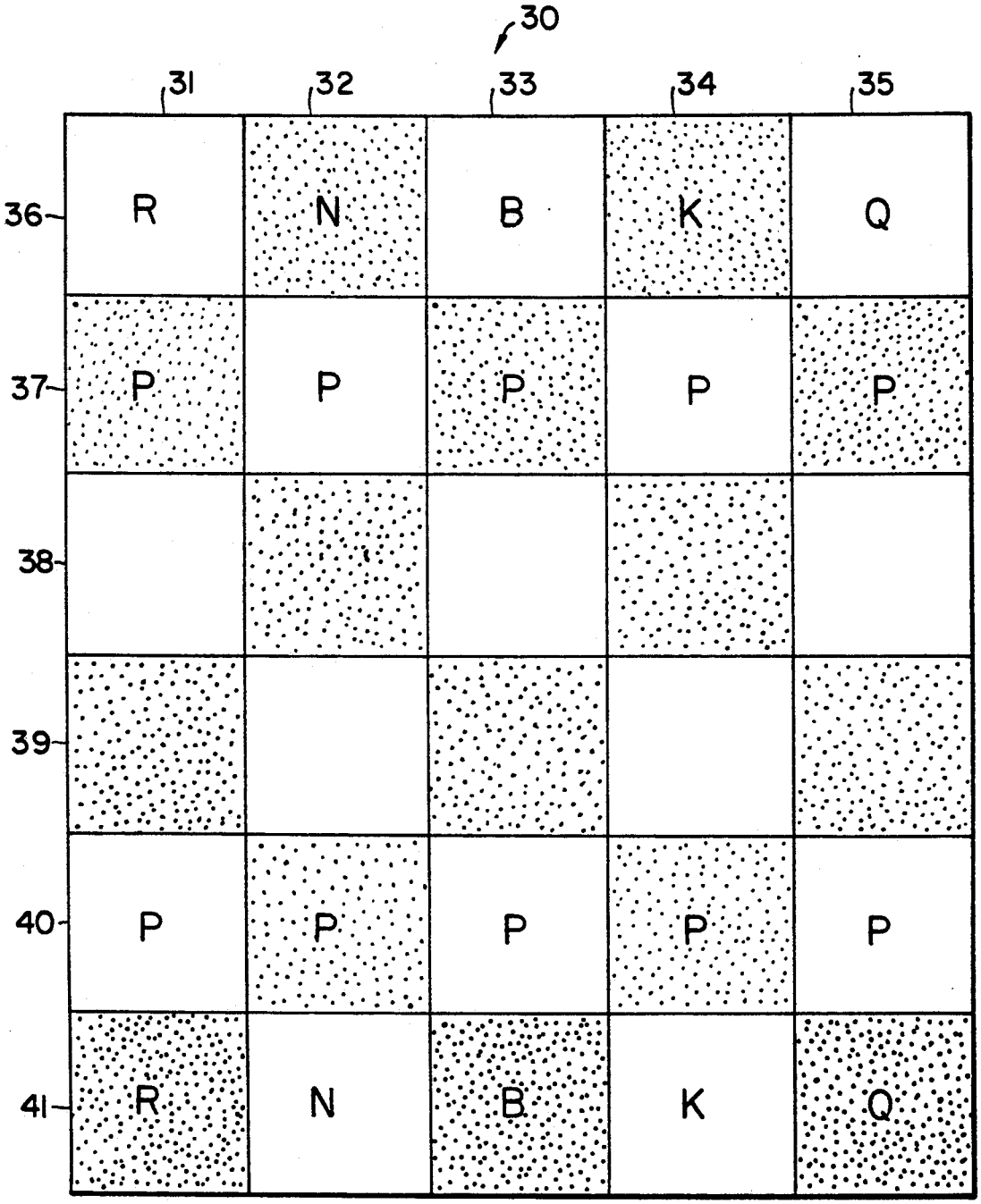

FIGS. 3 and 4 show initial set up patterns which present a more difficult level of play and can further serve to gradually prepare the growing beginner to move up to a traditional chess board. In each of these two cases the pieces are arranged in a pattern that simulates a segment of the traditional chess board. The differences are that in FIG. 3 the squares and pieces to one side of the KING are eliminated, and in FIG. 4 case the squares and pieces to the other side of the QUEEN are eliminated. Again, the opponent's pieces are always set up to mirror the opposite side of the board, as in traditional chess.

The set up patterns of FIGS. 3 and 4 serve to next familiarize the beginner with the ways the pieces are set up on a traditional board. They also allow an instructor to gradually introduce different components of traditional chess into the game as the beginning level chess student's ability and confidence grows. In particular, the FIG. 3 set up allows introduction of QUEEN side castling, and FIG. 4 allows introduction of KING side castling.

Figure 5:
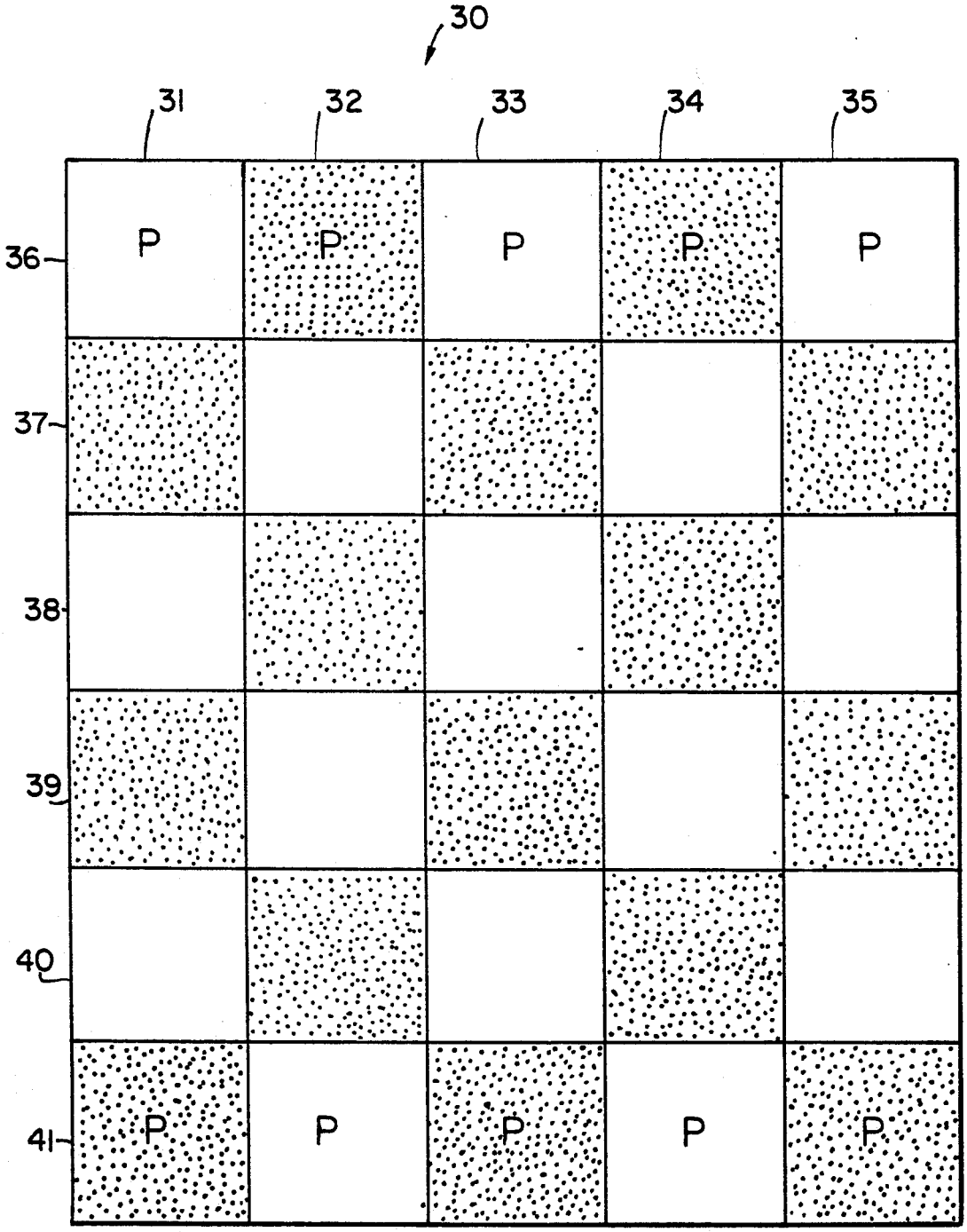
FIG. 5 is a variation of the initial set up of my game, for teaching KING side castling.

FIG. 5 is another initial set up in which the opposed end rows only include PAWNS. This set up will be used after the player, for which the instant invention is being used as a teaching tool, has mastered the basic skills of the game, as by utilizing the set up shown in FIG. 2. The purpose of FIG. 5 is to advance the individual learning the game to recognize the importance and strategic movement of the PAWNS. Referring to FIG. 5, five PAWNS are set up on each of the opposed base lines 36–41.

As in traditional chess, the PAWNS may advance two squares on their first move and en passant is permitted. While these moves are, as discussed above, not included in the game format shown in FIG. 2 they are necessary to know before advancing to the sophistication of traditional chess. This is taught with the arrangement shown in FIG. 5, which does not include other pieces, which may confuse the beginner who will now be concentrating only on PAWN movement. The objective of the FIG. 5 set up is to get a single PAWN to the other side of the board, with the player first doing this being the winner.

In the game of FIG. 5 the player learns to move the PAWNS in every way that they can be moved in traditional chess. Often in traditional chess the difference between winning and losing is determined by who gets a PAWN to the other side of the board first (thus getting promoted to another QUEEN). This often requires manipulation of several PAWNS in conjunction with sacrificing some to achieve this objective. This is an important part of chess and is learned easily in this simple 30 square, PAWN only environment of FIG. 5.

In traditional chess, if two opposite PAWNS advance 2 squares each on their first moves, they will end up face to face and deadlocked in the center of the board. In FIG. 5 this mimics the same result without the other pieces or the extra 34 squares of the traditional board of FIG. 1. It is here that the strategy of earlier PAWN engagement of traditional chess is learned. The unique set-up of FIG. 5 isolates this oftentimes confusing component of traditional chess and makes it appear simple and non intimidating to a new player.

When a player gets comfortable with manipulating PAWNS in the middle of a board, it will greatly enhance their game. One of the most common errors of new chess players is to underestimate the value of PAWNS. PAWN positioning is a critical part of chess. Bad PAWN development will almost certainly lead to losing. PAWNS must operate in conjunction with each other. This set up will prevent the player from considering the PAWN as just a single unimportant weak piece.

The player is also left the option of numerous other ways the pieces can be arranged along their baselines at the beginning of a game. Again, each one presenting different challenges and problems to solve. Due to the unique configuration of the board immediate goals can be approached upon rather shortly and learned from.

The simplified game board 30 allows the players to enjoy their new familiarity with the game while keeping with the objectives of gradual introduction and componential development to traditional chess and a quick game. Each new set up variation also fosters different thinking patterns because it prepares the student to react to unfamiliar development of play, of the type which eventually will present itself to even to the most astute of chess players in the later part of a traditional game, making it important to learning and player development. Yet, for the varying levels of beginners this is still accomplished in a friendly environment.

Also, as indicated earlier, a fast game is often more appealing to many chess players for varying reasons. If the beginner loses a game, the loss occurs quickly and he or she does not feel like they wasted a lot of time (in many cases hours), which can be devastating to enthusiasm. This significantly minimizes the sense of loss and allows the new player to recover and adjust quickly from their mistakes.

For a beginner the learning process can be fun because the familiarization process with how the pieces move is combined with actually playing a game, with winning as an objective, which may not be the case when you are just learning traditional chess and many other games. If this objective is one that is always within short reach of the beginner, the potential rewards are more immediate thus fostering continued desired to play.

For non-beginners a traditional chess game can take hours. Quite often people do not have that much time available. If they like to play games, chess may not otherwise be one of the choices during a lunch break or during an informal social event or other limited free time. The unique play quality of the present invention circumvents that problem and keeps people playing and enjoying the benefits of chess.

It will therefore be appreciated that the present invention provides a substantial simplification of chess, and an enhanced teaching means to introduce the beginner, and particularly children, to the game. Although a particular embodiment has been described and illustrated, it should be appreciated that modifications may be made while retaining the advantages and benefits of the present invention, which is defined by the following claims:

I claim:

1. A chess-like game comprising a gameboard and a plurality of playing pieces, said gameboard having a uniform checkerboard playing field consisting of alternate light and dark colored squares, arranged in adjacent horizontal and vertical rows, each of said rows including alternate light and dark colored squares, each square offset with respect to the similarly colored square of the adjacent row, to form a checkerboard pattern, said board consisting of five vertical rows, and at least six horizontal rows, said playing pieces including one set of light colored pieces and a set of dark colored pieces, each set of pieces consisting one each of a king, queen, rook, bishop and knight, and five pawns, each set of the same colored king-queen-rook-knight and bishop being initially located in the squares along a horizontal end row of the gameboard, and the five pawns of that colored set initially located along the adjacent penultimate horizontal row, each square within each of said vertical and horizontal rows providing an unobstructed location for movement of the playing pieces, the total number of playing piece locations on the gameboard for receiving a playing piece equal to five times the number of horizontal rows.

2. The chess-like game in accordance with claim 1, which includes less than eight horizontal rows.

3. The chess-like game in accordance with claim 1, which includes six horizontal rows and thirty unobstructed playing piece locations.

4. The chess-like game in accordance with claim 3, wherein initial pawn movement is limited to one square.

5. The chess-like game in accordance with claim 4, wherein pawn en passant movement is not permitted.

6. The chess-like game in accordance with claim 1, wherein the playing pieces of each set in its respective end horizontal row are initially successively located in the order of knight-queen-king-bishop-rook, with the corresponding pieces of the two sets being initially located in the same vertical row, at its opposite horizontal ends of the gameboard.

7. The chess-like game in accordance with claim 6, which includes six horizontal rows.

8. The chess-like game in accordance with claim 6, wherein castling movement between the rook and king is not permitted.

9. The chess-like game in accordance with claim 1, wherein the playing pieces initially located in each horizontal end row include the king at the center of the row.

10. The chess-like game in accordance with claim 1, wherein the playing pieces in each respective end horizontal row are initially located in the order of rook-knight-bishop-queen-king, and the game permits queen side casteling.

11. The chess-like game in accordance with claim 1, wherein the playing pieces in each respective end horizontal row are initially located in the order of rook-knight-bishop-king-queen and the game permits king side casteling.

12. A chess-like game comprising a gameboard and a plurality of playing pieces, said gameboard having a uniform checkerboard playing field consisting of alternate light and dark colored squares, arranged in adjacent horizontal and vertical rows, each of said rows including alternate light and dark colored squares, each square offset with respect to the similarly colored square of the adjacent row, to form a checkerboard pattern, said playing pieces including one set of light colored pieces and a set of dark colored pieces, each set of pieces consisting one each of a king, queen, rook, bishop and knight, and five pawns, each square within each of said vertical and horizontal rows providing an unobstructed location for movement of the playing pieces, the total number of playing piece locations on the gameboard for receiving a playing piece equal to the product of the number of vertical and horizontal rows.

13. The chess-like game in accordance with claim 12, wherein, said gameboard consists of five vertical rows and six horizontal rows and thirty unobstructed playing piece locations.

14. The chess-like game in accordance with claim 13, wherein, the same colored king-queen-rook-knight and bishop are initially located in the adjacent squares along the horizontal end row of the gameboard, and the five pawns of that colored set are initially located along the adjacent penultimate horizontal row.

* * * * *